US005092242A

United States Patent [19]

Knauer

[11] Patent Number: 5,092,242

[45] Date of Patent: Mar. 3, 1992

[54] LATERAL AND CIRCUMFERENTIAL REGISTER ADJUSTMENT SYSTEM FOR A ROTARY PRINTING MACHINE

[75] Inventor: Peter Knauer, Rain, Fed. Rep. of Germany

[73] Assignee: Man Roland Druckmaschinen AG, Offenbach am Main, Fed. Rep. of Germany

[21] Appl. No.: 528,589

[22] Filed: May 24, 1990

[30] Foreign Application Priority Data

Jun. 3, 1989 [DE] Fed. Rep. of Germany ..... 3918128

[51] Int. Cl.[5] ..... B41F 13/24

[52] U.S. Cl. ..... 101/248; 101/181

[58] Field of Search ..... 101/248, 216, 174, 181

[56] References Cited

U.S. PATENT DOCUMENTS

| | | | |
|---|---|---|---|
| 2,260,402 | 10/1941 | Potdevin | 101/248 |
| 2,775,935 | 1/1957 | Reinartz et al. | 101/248 |
| 3,791,294 | 2/1974 | Skelding et al. | 101/248 |
| 4,207,815 | 6/1980 | Watanabe | 101/248 |
| 4,363,270 | 12/1982 | Ury et al. | 101/248 |
| 4,606,269 | 8/1986 | Jeschke | 101/248 |
| 4,709,634 | 12/1987 | Momot et al. | 101/248 |
| 4,807,527 | 2/1989 | Knauer . | |
| 4,833,983 | 5/1989 | Chen | 101/181 |

FOREIGN PATENT DOCUMENTS

| | | | |
|---|---|---|---|
| 0019697 | 12/1980 | European Pat. Off. . | |
| 1290941 | 3/1969 | Fed. Rep. of Germany . | |
| 3409194 | 9/1985 | Fed. Rep. of Germany . | |
| 2057970 | 3/1981 | United Kingdom | 101/248 |

*Primary Examiner*—Edgar S. Burr
*Assistant Examiner*—Christopher A. Bennett
*Attorney, Agent, or Firm*—Frishauf, Holtz, Goodman & Woodward

[57] ABSTRACT

To provide a clean operator side (I) of a printing machine, the circumferential and lateral register adjustment of a plate cylinder (20) is located on the machine or drive side (II) of the machine and is formed by a special gearing arrangement; a first gear (12) which is rotatable on an axially shiftable stub shaft (19) of the plate cylinder by being positioned on a bearing thereof, is driven from a second gear (9) which may also drive an offset blanket cylinder (18). The first gear is in meshing engagement with a dual gear, having third and fourth gearings (16, 15), the first, second and third gears being spiral or inclined, and the fourth gear (15), which meshes with an axial fixed fifth gear (13) splined to the shaft fo the cylinder (19), is likewise formed with axial teeth. The combined third and fourth gears can be shifted axially, thus causing rotation of the fourth gear by the "thread" type engagement of the third gear with the first gear, which rotation is transferred to the fifth gear and hence to the plate cylinder; in addition, the axial position of the plate cylinder is independently adjustable by a spindle (29) moving the stub shaft without transmitting rotation thereto or receiving rotation therefrom.

16 Claims, 2 Drawing Sheets

LATERAL AND CIRCUMFERENTIAL REGISTER ADJUSTMENT SYSTEM FOR A ROTARY PRINTING MACHINE

FIELD OF THE INVENTION

The present invention relates to printing machines, and more particularly to printing machines having all gearing and associated apparatus located on one side, hereinafter the machine side or side II of the machine, whereas the other side will be referred to as the operator side or side I.

BACKGROUND

Rotary printing machines usually use drive gearing which includes at least some gears with inclined or spiral teeth. Upon axial shifting of a cylinder, lateral as well as circumferential register can be changed. It has also been proposed to provide rotary printing machines with forme and blanket cylinders which do not have attachment grooves for printed image carriers and/or rubber blankets but, rather, in which the image carriers and/or rubber blankets are applied in the form of circumferentially continuous sleeves about the respective cylinders.

European Patent 0 019 697, as an example, illustrates a rotary offset printing machine having a register adjustment arrangement located at the operating side I of the printing machine. Usually, lateral and circumferential register in rotary printing machines is obtained by axially shifting and rotating the cylinder, customarily the plate or forme cylinder of the printing machine. Register adjustment, thus, is possible from one side, the operator side I only, and all drive gearing and the like, for example in form of gear trains, is located on the machine side II.

The arrangement is satisfactory for many rotary printing machines. For various reasons, however, placing the register adjustment control system at the operator side is not suitable, or even impossible. This is particularly so when rotary printing machines are used in which the cylinders do not have clamping grooves but, rather, in which the respective cylinders carry circumferentially continuous sleeves. If so, one side of the printing machine must be freely accessible so that the sleeves can be applied on the cylinders. The drive side of the machine is unsuitable because it would require disassembly of numerous gears in order to provide axial access to the respective cylinders. The referenced U.S. Pat. No. 4,807,427 shows a printing machine in which one side wall is formed with an opening sufficient to permit re-sleeving of a cylinder.

It is an object of the present invention to provide a rotary printing machine which has an apparatus or system to adjust the lateral and circumferential register and which is so constructed that the operator side is not needed to provide for the adjustment or register control arrangement. Thus, adjustments should be capable of being made only from the drive side of the machine, so that the operator side will not be required for any adjustment apparatus or system.

Briefly, a spiral gear coupled to a cylinder which is to be adjustable with respect to a circumferential and axial register position, for example the plate cylinder of a rotary offset printing machine, is coupled to an axially shiftable spiral gearing. The spiral gear can be driven from another cylinder, or from the drive train. This spiral gear is in engagement with another spiral gear which is coupled to a gear having axially arranged teeth, for example by a dual gear ring structure. The dual gear ring structure, also, is axially shiftable, and coupled to a further axial gear which is seated in predetermined axial and angular position on the shaft of the cylinder to be adjusted, and splined thereto, so as to transmit rotary power. Thus, upon axial adjustment, respectively, of the shaft of the respective cylinder, the lateral register can be adjusted; upon axial adjustment of the coupled spiral gear - axial gear arrangement, the circumferential register of the respective cylinder can be adjusted.

The system has the advantage that the drive connection to the printing machine cylinders requires only minimum modification to, also, provide for register adjustment of a cylinder with respect to a drive, both in circumferential and axial direction, while leaving the operator side of the machine unencumbered by any adjustment mechanism.

DRAWINGS

FIG. 1 is a schematic representation of a drive train of a rotary offset printing machine; and FIG. 2 is a schematic part-axial sectional view illustrating the arrangement of the system to control both lateral and circumferential register of a cylinder by rotation and axial shift of the register.

DETAILED DESCRIPTION

Figure 1:
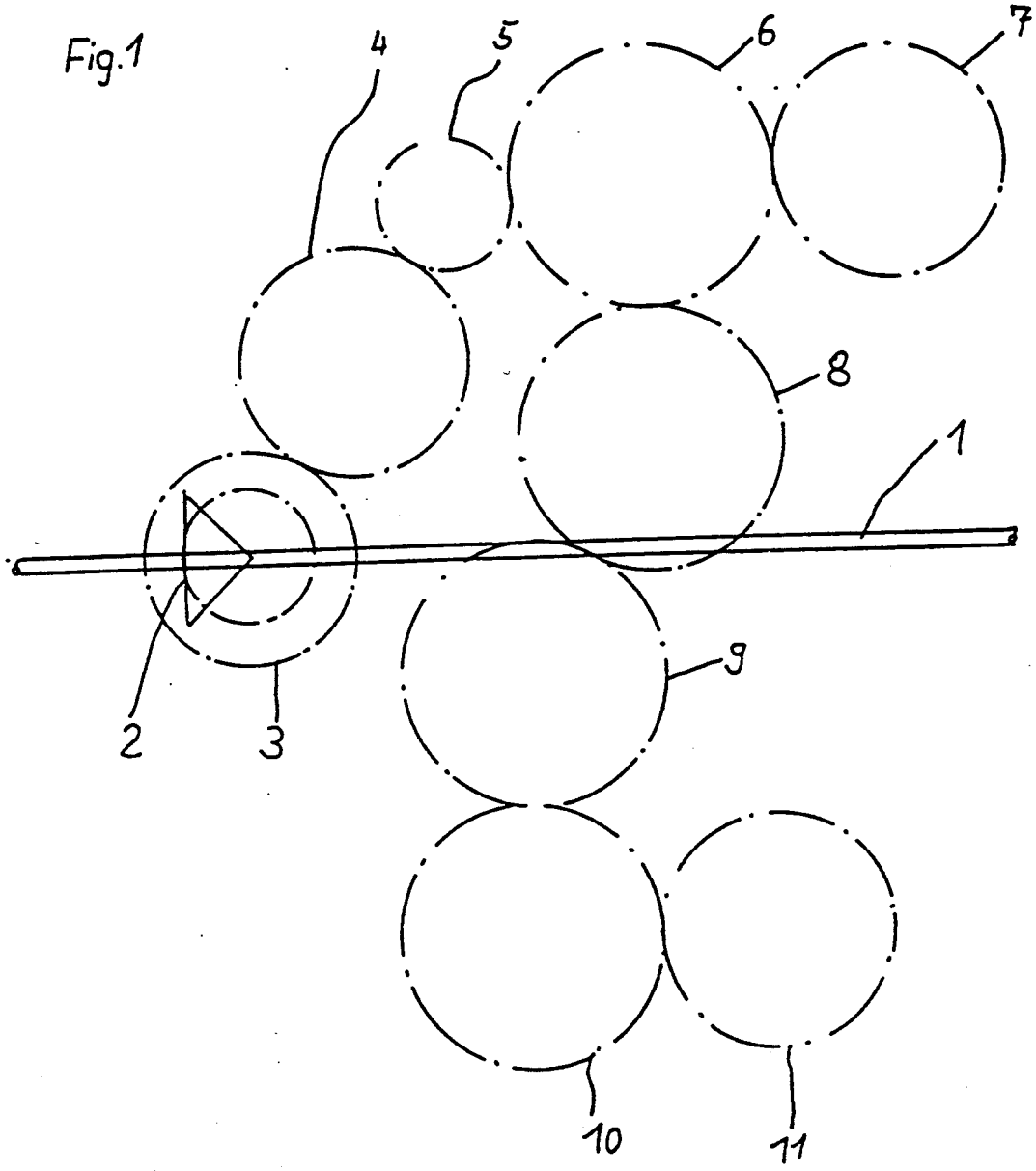

Referring first to FIG. 1:

The drive of a schematically shown rotary printing machine is obtained from a main shaft 1 which, typically, extends horizontally. A bevel gear 2, having inclined gearing, meshes with the gear 3 which, in turn, meshes with gears 4 and 5, likewise with inclined or spiral gear teeth.

The upper plate cylinder gear 6, likewise with spiral gear teeth, is in meshing engagement with the drive gear 5 of the gear train 2–5. Gear 6 of the upper plate cylinder is in meshing engagement with the upper blanket cylinder drive gear 8. The upper blanket cylinder drive gear 8 drives a lower blanket cylinder drive gear 9 which is in engagement with the lower plate cylinder gear 10. Circumferential register gear wheels 7 and 11 are in engagement with the plate cylinder gears 6 and 10.

Figure 2:
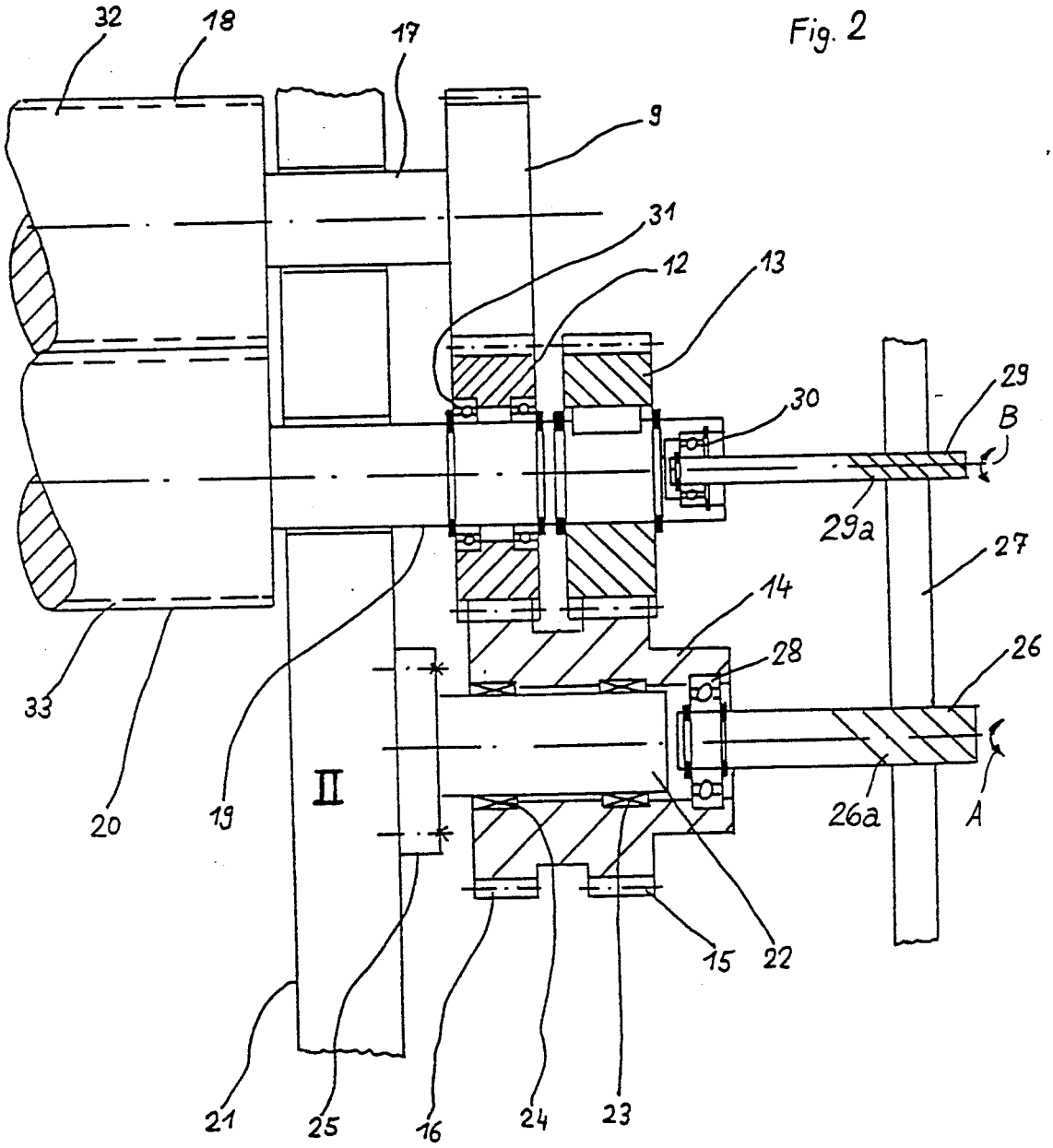

The register adjustment system to control and adjust the lateral register as well as the circumferential register is best seen in FIG. 2.

In accordance with the present invention, all register adjustment controls are located on the drive or machine side II of the rotary printing machine, so that no operator accessible adjustment elements are required at the operator side I. The operator side I has been omitted from the drawings for clarity. The operator side then is freely accessible so that, for example, through openings in the side wall or side frame of the operator side, sleeves can be applied to the respective printing cylinders, or removed therefrom, for example for replacement. There are various other reasons which also may make it desirable or necessary to have a smooth operator side, without any register control arrangements thereon.

The drive arrangement shown in FIG. 1 is so modified that the power is initially transferred to a blanket cylinder gear, for example gear 8 or 9. The blanket cylinder gear 9, with spiral or inclined gear teeth, meshes with a plate cylinder gear 12. Plate cylinder gear 12 is loosely journalled through hearing 3 on a stub shaft 19 of the plate cylinder 20. A spur gear 13, with axially arranged gear teeth, is secured on the shaft 19 to rotate therewith, for example by being splined thereto. The respective gears are maintained in axial condition by suitable holding arrangements, for example C-rings or the like, as well known.

Gears 12 and 13 mesh with gear rings 15 and 16 of a dual gear core 14. The gearings 15 and 16, alternatively, could be formed as separate- gears which are coupled together. The gear core 14, or individual gears carrying gearings 15, 16 are freely rotatable but axially shiftable on a stub shaft 22, which, for example, is secured to the side wall 21 at the drive or machine side II by a flange 25. Bearings 23, 24 permit relative rotation of the gear rings 15, 16 with respect to the fixed stub 22. Axial shifting of the gear core 14, or of the gear rings 15, 16, is possible.

Usually, the inclined gear 9 of the blanket cylinder, by its fixed attachment to the stub shaft 17 on the cylinder 18, drives the cylinder directly.

For ease of explanation, gears 12, 9 and 16 will be referred to as the first, second and third gears, which, each, have inclined or spiral gear teeth. Gears 15 and 13, referred to as the fourth and fifth gear, rather, have axially directed gear teeth. The fifth gear 13 is secured on the stub shaft 19 of the forme or plate cylinder 20 to rotate the forme or plate cylinder.

The arrangement of the gear train permits independent adjustment of the circumferential register as well as of the lateral register of the plate or forme cylinder.

A guide plate 27 is secured by suitable means, not shown, to the side wall 21 of the machine, in fixed position. A threaded spindle 26, carrying threads 26*a*, is threaded through a suitable tapped opening in the plate 27. The left side - with respect to FIG. 2 - of the threaded spindle 26 is secured to the core element 14 through bearing 28 or, alternatively, to a similar element coupled to the coupled gear rings 15, 16, to permit rotation of the core element 14 with respect to the spindle 26, while, at the same time, providing for axial shifting of the gear rings 15, 16 with respect to the side wall 21 or, in other words, with respect to the plate 27 in which the spindle 26 is threaded. Upon rotation of the spindle 26 in the guide plate 27, see arrow A, the spindle moves towards the right or left, in dependence on the direction of rotation, and thereby carries the core 14 or, respectively, the two gears 15, 16, which are axially shiftable on the stub shaft 22, while being rotatable with respect thereto. Upon axial shifting of the core element 14, the forme or plate cylinder 20 will rotate due to the inclined gears of the gear ring 16, since the inclined gears of the third gear 16 and the inclined gears of the first gear 12 are in meshing engagement.

Lateral register of the forme or plate cylinder 20 is obtained by rotating the threaded spindle 29, which carries threads 29*a* within a tapped hole in the plate 27. Spindle 29, at the end thereof, is coupled to a bearing 30 which is fitted within the stub shaft 19, to move the stub shaft 19, and hence the cylinder 20 in axial direction. Upon rotation of the spindle 29, see arrow B, and in dependence on the direction of rotation, the associated cylinder 20 will shift between left and right positions. The left end of the spindle 29 can rotate freely within the bearing 30. Upon rotation of the spindle 29, however, the stub shaft 19 and hence the cylinder 20 will shift axially.

Spindles 26 and 29 can be rotated manually or by a motor, for example servo motor drive.

OPERATION (1) CIRCUMFERENTIAL REGISTER ADJUSTMENT

In accordance with a feature of the present invention, rotation of the spindle 26 shifts the dual gear 16, 15, by shifting the core element 14 in axial direction on the fixed stub shaft 22. The second and first gears 9, 12, respectively, may be considered as being quasi-rotation blocked. Consequently, the inclined gear ring 16 will, upon rotation of the spindle 26, so-to-speak worm or screw itself axially in the inclined gearing of the gear 12, that is, the core element 14 moves towards the right or left while rotating about the stub shaft 22. This rotation of the core element 14 causes a consequent rotation of the fifth gear 13 via the axially oriented fourth gear 15, thus rotating the forme or plate cylinder 20 to which the fifth gear 13 is splined.

This circumferential register adjustment by rotating the spindle 26 can be carried out while the plate cylinder is stationary as well as when it is printing or running in the printing machine. The only operation which matters is that, upon axial shifting of the gears 16, 15 by shifting the core element 14, the gears 12 and 9, that is, the entire spiral gear train, provides a counter force sufficiently strong so that, upon axial shifting of the spindle 26, the gear 16 must rotate with respect to gear 12. This rotary movement, then, via the fourth gear 15 and the fifth gear 13 provides for circumferential register adjustment.

OPERATION (2) LATERAL REGISTER ADJUSTMENT

Spindle 29, upon being rotated as schematically shown by the double arrow B, shifts the stub shaft 19, and hence the associated cylinder 20 towards the left or right. The left end of the spindle 29 can freely rotate in bearing 30, while, upon rotation of the spindle 29, the stub shaft 19 and hence the cylinder 20 are carried along. Axial movement of the plate cylinder 20 or, respectively, its stub shaft 19 and the fifth gear 13 coupled to the stub shaft while transmitting rotation, does not influence the circumferential register, since both the fourth and fifth gears 15 and 13 have axially oriented gear teeth.

Preferably, blanket cylinder 18 as well as the forme cylinder 20 are covered with replaceable sleeves 32, 33, respectively. The sleeve 32 has a rubber or rubberized surface; sleeve 33 carries the printing image. The printing image is inked by a suitable inker, not shown; cylinders 18, 19 may have other surfaces applied thereto, for example be covered with rubber blankets, plates, or the like.

Various changes and modifications may be made within the scope of the inventive concept.

I claim:

1. In a rotary printing machine having a first cylinder (20) which is axially movable and rotationally shiftable with respect to an angular reference position, a circumferential and lateral register adjustment system comprising shaft means (19) journalled in the machine coupled to said first cylinder (20) to rotate and axially position said first cylinder;

a first gear (12) with spiral or inclined gear teeth rotatably located on said shaft means (19) in axially fixed position;

a second gear (9) having spiral or inclined gear teeth thereon;

said first and second gears (12, 9) being in meshing engagement;

idler shaft means (22) secured to the machine;

a third gear (16) with spiral or inclined gear teeth rotatably located on said idler shaft means, and meshing with said first gear (12);

a fourth gear with axially oriented gear teeth located on said idler shaft means and coupled to said third gear (16) for rotation and axial positioning conjointly therewith;

a fifth gear (13) with axially oriented gear teeth coupled to said shaft means (19) for rotating said shaft means and hence said first cylinder (20);

first axial shifting means (26, 26*a*, 27) coupled to both the third gear (16) and the fourth gear (15); and second axial shifting means (29) coupled to said fifth gear (13) and hence to said first cylinder (20), said third gear (16), due to the inclined or spiral teeth thereon, rotating about axial shifting thereof and thereby rotating said first cylinder (20) via the fourth and fifth gears upon operation of said first axial shifting means, and said second axial shifting means (29) axially moving said first cylinder (20) without affecting its rotary position due to coupling thereof with said fifth gear (13) having axially oriented gear teeth.

2. The adjustment system of claim 1, further including a common core means (14) on which said third gear (16) with the spiral or inclined gear teeth and the fourth gear (15) with the axially oriented gear teeth are located, to form two gear rings on a dual gear core.

3. The adjustment system of claim 1, wherein said first axial shifting means (26) comprises a threaded spindle (26);

means (27) for threadedly receiving the threaded spindle, and secured in fixed position with respect to said printing machine;

and a bearing (28) coupling the spindle (26) to the conjointly rotatable third and fourth gears for providing rotation to said first cylinder (20).

4. The adjustment system of claim 3, further including a common core means (14) on which said third gear (16) with the spiral or inclined gear teeth and the fourth gear (15) with the axially oriented gear teeth are located, to form two gear rings on a dual gear core;

and wherein said bearing (28) is coupled to said core means to provide for axial movement of the core means while permitting relative rotation thereof with respect to said spindle (26).

5. The adjustment system of claim 1, wherein said second axial shifting means (29) comprises a second threaded spindle (29) threadedly received in a threaded bearing located at a fixed position with respect to a side wall of the machine;

and a bearing (30) in axial fixed position on said shaft means (19) and coupled to said second spindle (29) to provide for axial shifting of said shaft means (19) and said first cylinder (20) independently of rotation of said shaft means and said cylinder with respect to said spindle (29).

6. The adjustment system of claim 1, further including a main drive shaft (1) and a gear drive train (2, 3, 4, 5);

said drive train being coupled to said second gear (9) and terminating in a gear which has inclined or spiral gear teeth, meshing with said second gear (9);

and wherein a shaft bearing (31) is provided, rotatably retaining said first gear (12) on said shaft means (19).

7. The adjustment system of claim 1, wherein said first cylinder comprises the plate or forme cylinder of a printing machine.

8. The adjustment system of claim 1, wherein a second cylinder (18) is provided, coupled for rotation by said second gear (9), said second cylinder comprising an offset or blanket cylinder.

9. The adjustment system of claim 8, wherein said first cylinder comprises the plate or forme cylinder of a printing machine;

wherein said offset or blanket cylinder (18) includes a circumferentially continuous rubber surface sleeve (32) thereon; and the plate or forme cylinder (20) comprises a circumferentially continuous sleeve (33) carrying a printed image, said sleeves being respectively exchangeable.

10. The adjustment system of claim 1, wherein said machine includes a machine or drive side (II) carrying said first through fifth gears (12, 9, 16, 15, 13) , and further carrying drive gears (3–5) for driving said first through fifth gears, and wherein said register adjustment system is located solely on said drive or machine side (II).

11. In a rotary printing machine having a plate cylinder (20) which is axially movable and rotatably shiftable with respect to an angular reference position, said printing machine defining a drive or machine side (II), and including gear means (3, 4, 5) for transmitting rotary power to said first cylinder, a circumferential and lateral adjustment system located solely at said machine or drive side (II), said circumferential and lateral adjustment system comprising, in accordance with the invention, shaft means (19) journalled in the machine coupled to said first cylinder (20) to rotate and axially position said first cylinder;

a first gear (12) with spiral or inclined gear teeth rotatably located on said shaft means (19) in axially fixed position;

a second gear (9) having spiral or inclined gear teeth thereon;

said first and second gears (12, 9) being in meshing engagement;

idler shaft means (22) secured to the machine;

a third gear (16) with spiral or inclined gear teeth rotatably located on said idler shaft means, and meshing with said first gear (12);

a fourth gear with axially oriented gear teeth located on said idler shaft means and coupled to said third gear (16) for rotation and axial positioning conjointly therewith;

a fifth gear (13) with axially oriented gear teeth coupled to said shaft means (19) for rotating said shaft means and hence said first cylinder (20);

first axial shifting means (26, 26*a*, 27) coupled to both the third gear (16) and the fourth gear (15); and second axial shifting means (29) coupled to said fifth gear (13) and hence to said first cylinder (20), said third gear (16), due to the inclined or spiral teeth thereon, rotating about axial shifting thereof and thereby rotating said first cylinder (20) via the fourth and fifth gears upon operation of said first axial shifting means, and said second axial shifting means (29) axially moving said first cylinder (20) without affecting its rotary position due to coupling thereof with said fifth gear (13) having axially oriented gear teeth.

12. The adjustment system of claim 11, wherein said first axial shifting means comprises a threaded spindle (26);

means (27) for threadedly receiving the threaded spindle, and secured in fixed position with respect to said printing machine;

and a bearing (28) coupling the spindle (26) to the conjointly rotatable third and fourth gears for providing rotation to said first cylinder (20).

13. The adjustment system of claim 11, wherein said second axial shifting means (29) comprises a second threaded spindle (29) threadedly received in a threaded bearing located at a fixed position with respect to a side wall of the machine;

and a bearing (30) in axial fixed position on said shaft means (19) and coupled to said second spindle (29) to provide for axial shifting of said shaft means (19) and said first cylinder (20) independently of rotation of said shaft means and said cylinder with respect to said spindle (29).

14. The adjustment system of claim 11, further including a common core means (14) on which said third gear (16) with the spiral or inclined gear teeth and the fourth gear (15) with the axially oriented gear teeth are located, to form two gear rings on a dual gear core.

15. The adjustment system of claim 11, wherein a second cylinder (18) is provided, coupled for rotation by said second gear (9), said second cylinder comprising an offset or blanket cylinder.

16. The adjustment system of claim 15, wherein said offset or blanket cylinder (18) includes a circumferentially continuous rubber surface sleeve (32) thereon; and the plate or forme cylinder (20) comprises a circumferentially continuous sleeve (33) carrying a printed image, said sleeves being respectively exchangeable.

* * * * *